US009175926B2

(12) United States Patent
Keng et al.

(10) Patent No.: US 9,175,926 B2
(45) Date of Patent: Nov. 3, 2015

(54) SYSTEMS, METHODS, AND APPARATUS FOR PROVIDING A FIREARM SIGHT COMPRISING A CLOSED POSITION AND AN OPEN POSITION

(71) Applicant: Keng's Firearms Specialty, Inc., Atlanta, GA (US)

(72) Inventors: Da Keng, Smyma, GA (US); Aaron L. Hampton, Columbus, GA (US); Maciej W. Matuszczak, Woodstock, GA (US)

(73) Assignee: Keng's Firearms Specialty, Inc., Atlanta, GA (US)

( * ) Notice: Subject to any disclaimer, the term of this patent is extended or adjusted under 35 U.S.C. 154(b) by 0 days.

(21) Appl. No.: 14/097,666

(22) Filed: Dec. 5, 2013

(65) Prior Publication Data

US 2014/0150324 A1 Jun. 5, 2014

Related U.S. Application Data

(60) Provisional application No. 61/733,687, filed on Dec. 5, 2012, provisional application No. 61/733,688, filed on Dec. 5, 2012.

(51) Int. Cl.

| | |
|---|---|
| ***F41G 1/08*** | (2006.01) |
| ***F41G 1/30*** | (2006.01) |
| ***F41G 11/00*** | (2006.01) |
| *F41G 1/00* | (2006.01) |

(52) U.S. Cl.

CPC ..... *F41G 1/30* (2013.01); *F41G 11/003* (2013.01); *F41G 1/00* (2013.01); *Y10T 29/49826* (2015.01)

(58) Field of Classification Search

USPC ..... 42/111, 118, 124–128, 148

See application file for complete search history.

(56) References Cited

U.S. PATENT DOCUMENTS

| | | | | | |
|---|---|---|---|---|---|
| 2,529,801 | A | * | 11/1950 | Fisk | 42/128 |
| 2,710,453 | A | * | 6/1955 | Beverly | 42/128 |
| 3,178,823 | A | * | 4/1965 | Lipski | 42/126 |
| 3,732,642 | A | * | 5/1973 | Bray | 42/124 |
| 4,446,644 | A | * | 5/1984 | Jimenez et al. | 42/127 |
| 4,461,087 | A | * | 7/1984 | Norman | 42/128 |
| 4,574,508 | A | * | 3/1986 | Ross | 42/124 |
| 5,208,989 | A | * | 5/1993 | Sanders | 42/123 |
| 5,680,725 | A | * | 10/1997 | Bell | 42/127 |

(Continued)

FOREIGN PATENT DOCUMENTS

| | | |
|---|---|---|
| JP | 2012-202573 A | 10/2012 |
| KR | 10-1171615 B1 | 8/2012 |

OTHER PUBLICATIONS

Search Report and Written Opinion for International Application No. PCT/US2013/073321 mailed Mar. 18, 2014.

(Continued)

*Primary Examiner* — Michael David

(74) *Attorney, Agent, or Firm* — Sutherland Asbill & Brennan LLP

(57) ABSTRACT

A firearm sight is disclosed herein. The firearm sight may include a housing, a main body assembly, and a sight assembly. The main body assembly may be operably attached to the housing, and the sight assembly may be operably attached to the main body assembly. Moreover, a deployment mechanism may be operable to deploy the main body assembly and the sight assembly from a closed position at least partially within the housing to an open position at least partially outside of the housing.

11 Claims, 13 Drawing Sheets

(56) References Cited

U.S. PATENT DOCUMENTS

| | | | | |
|---|---|---|---|---|
| 6,622,415 | B1 * | 9/2003 | Canaday et al. | 42/140 |
| 7,367,152 | B2 * | 5/2008 | Samson | 42/128 |
| 7,543,405 | B1 * | 6/2009 | Ivey | 42/125 |
| 7,726,229 | B2 * | 6/2010 | Schwerman et al. | 89/41.17 |
| 7,814,698 | B2 | 10/2010 | Fluhr et al. | |
| 7,870,688 | B1 * | 1/2011 | Dasiukevich | 42/124 |
| 7,908,782 | B1 | 3/2011 | LaRue | |
| D663,006 | S * | 7/2012 | Storch | D22/108 |
| 8,393,105 | B1 * | 3/2013 | Thummel | 42/90 |
| 8,769,859 | B2 * | 7/2014 | Li et al. | 42/124 |
| 2005/0188602 | A1 | 9/2005 | Swan | |
| 2006/0179704 | A1 * | 8/2006 | Dextraze | 42/126 |
| 2008/0034638 | A1 | 2/2008 | Spuhr | |
| 2011/0296732 | A1 | 12/2011 | Carlson et al. | |
| 2011/0296734 | A1 | 12/2011 | Troy | |
| 2012/0180368 | A1 | 7/2012 | Haley et al. | |

OTHER PUBLICATIONS

Search Report and Written Opinion for International Application No. PCT/US2013/073323 mailed Mar. 19, 2014.

* cited by examiner

SYSTEMS, METHODS, AND APPARATUS FOR PROVIDING A FIREARM SIGHT COMPRISING A CLOSED POSITION AND AN OPEN POSITION

CROSS-REFERENCE TO RELATED APPLICATION

The present application claims priority to and the benefit of U.S. Provisional Patent Application Nos. 61/733,687 and 61/733,688, filed Dec. 5, 2012, which are both hereby incorporated by reference in their entirety.

FIELD OF THE DISCLOSURE

The disclosure generally relates to firearm accessories and more particularly relates to systems, methods, and apparatus for providing a firearm sight.

BACKGROUND

A trend in the firearms field has been to move away from purely mechanical firearm sights (such as iron sights) and move towards electronic reflex-type (or red dot) firearm sights which offer no magnification. These types of firearm sights, while generally robust, may fail to reliably function on a regular basis and therefore must be supplemented by back-up iron sight assemblies that allow a user to "flip" up the iron sights into the sighting plane when the electronic firearm sights fail. The user is able to sight the firearm by viewing the front sight of the firearm through the non-functional electronic sight and aligning it with the aperture or other sighting mechanism on the rear backup sight. This system, while marginally effective with the previous generation of non-magnified electronic or optical firearm sights, has, in certain instances, been rendered unusable on the new generation of magnified optical sight devices. One reason for this is that the fixed front sight of the firearm cannot be viewed through the restricted view of a magnified sight device.

SUMMARY

Some or all of the above needs and/or problems may be addressed by certain embodiments of the firearm sight disclosed herein. According to an embodiment, the firearm sight may include a housing, a main body assembly, and a sight assembly. The main body assembly may be operably attached to the housing, and the sight assembly may be operably attached to the main body assembly. Moreover, a deployment mechanism may be operable to deploy the main body assembly and the sight assembly from a closed position at least partially within the housing to an open position at least partially outside of the housing.

Other features and aspects of the firearm sight will be apparent or will become apparent to one with skill in the art upon examination of the following figures and the detailed description. All other features and aspects, as well as other systems, methods, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
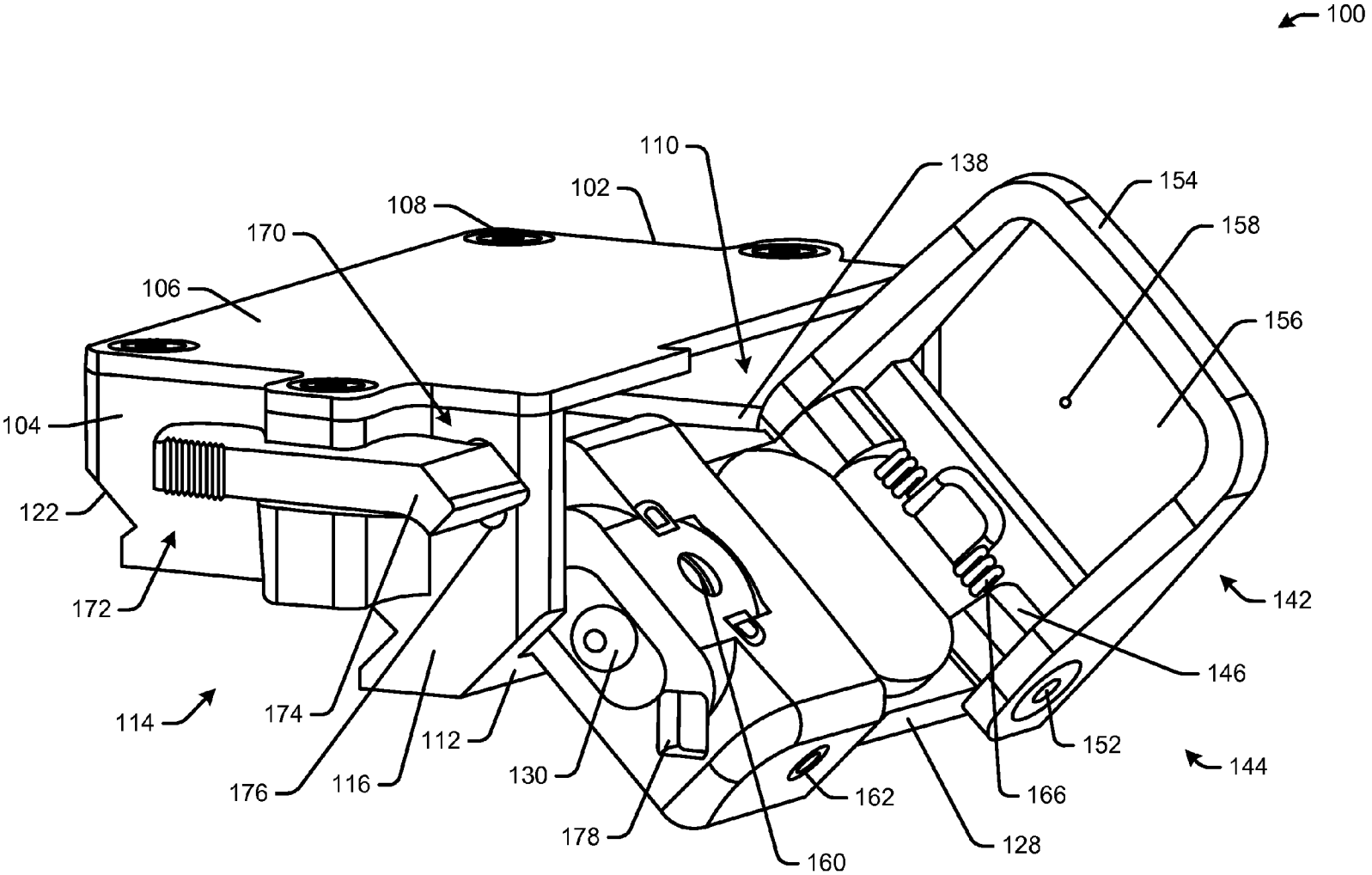
FIG. 1 schematically depicts a firearm sight in accordance with one or more embodiments of the disclosure.
Figure 2:
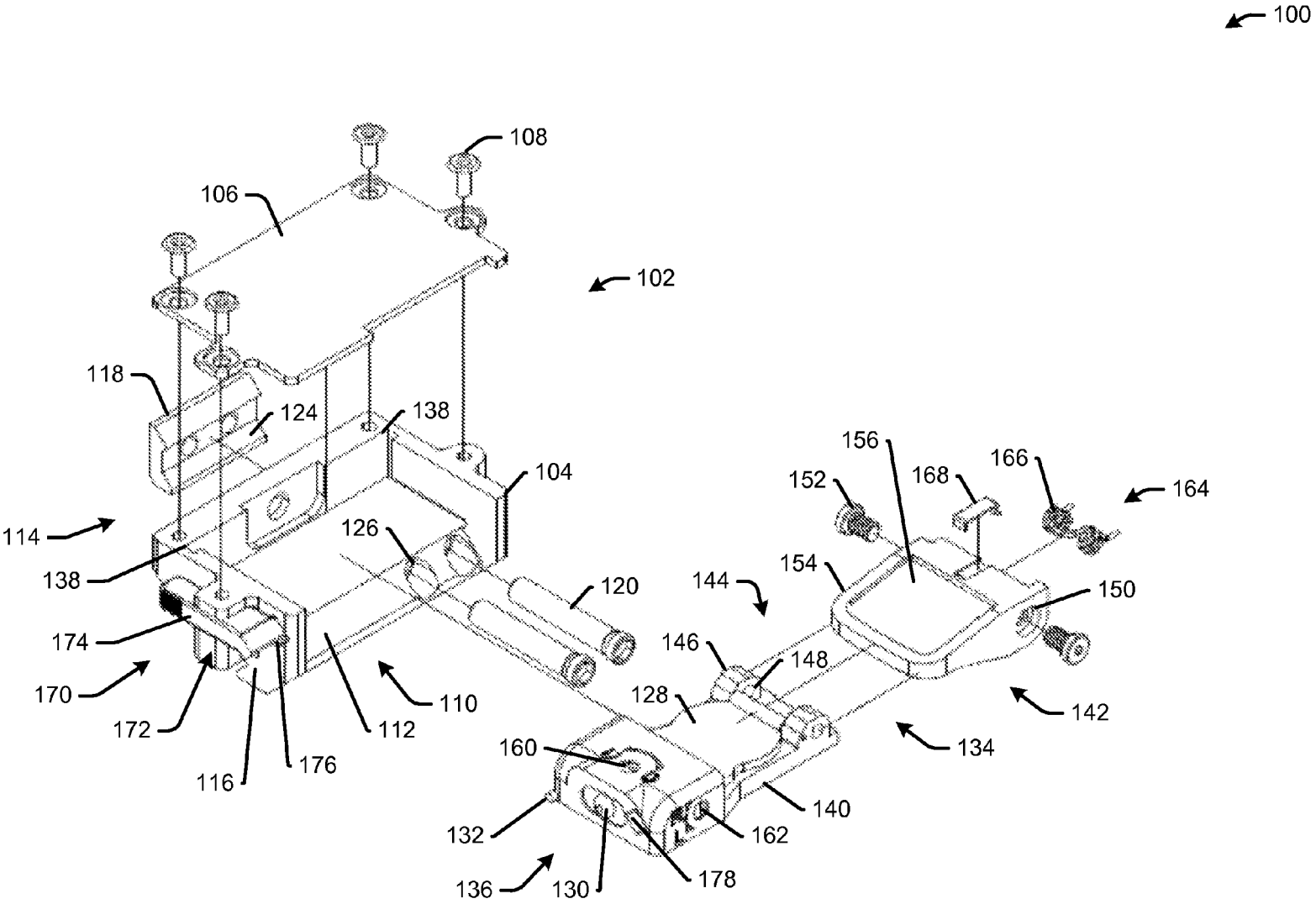
FIG. 2 schematically depicts a firearm sight in accordance with one or more embodiments of the disclosure.

Described below are embodiments of a firearm sight (as well as individual components of the firearm sight) that can be attached to a firearm. Methods of manufacturing, installing, and/or using the firearm sight are also disclosed. In some instances, the firearm sight may function as a secondary firearm sight. That is, the firearm sight may supplement a primary firearm sight. For example, the firearm sight may be deployed in instances where the primary firearm sight has malfunctioned or is inoperable.

The firearm may be a conventional firearm. For example, the firearm may be a handgun. In some instances, the firearm may be a rifle, such as an M-16 style rifle, an AR-15 style rifle, an AR-10 style rifle, or an M-4 style rifle, among others. In other instances, the firearm may be a shotgun. Any firearm may be used in association with the firearm sight disclosed herein. In some instances, the firearm may include an attachment point, such as a rail assembly or the like. In an example embodiment, the rail assembly may be a Picatinny rail assembly.

Certain embodiments of the firearm sight can provide the technical effect and/or solution of improved control and stability, resulting in improved firearm accuracy and performance. Moreover, the firearm sight may provide the technical effect and/or solution of improved maneuverability and/or configurability. For example, the firearm sight may be stowed and deployed with relative ease. In some instances, the firearm sight can be mounted on the rail assembly of the firearm underneath the primary firearm sight in a space that is otherwise not utilized. Such a configuration can minimize the bulk and/or protrusion from the side of the firearm and can offer additional protection to the firearm sight since the firearm sight may be shielded by the primary firearm sight from shock and blunt forces. Other technical effects and/or solutions may become apparent throughout the disclosure.

Generally speaking, the firearm sight may include a housing. In some instances, the housing may at least partially enclose one or more components of the firearm sight. The housing may be attached to a firearm. For example, an attachment assembly may be configured to attach the housing to the firearm. In some instances, the attachment assembly may include a fixed clamp, a moveable clamp, and at least one coupling rod. The moveable clamp may be operable to move relative to the fixed clamp between a clamped position and an unclamped position. The coupling rod may be positioned between the fixed clamp and the moveable clamp. In this manner, manipulation of the coupling rod may move the moveable clamp between the clamped positioned and the unclamped position. In some instances, the coupling rod may be configured to at least partially protrude between at least two mounting projections on the rail assembly of the firearm. Moreover, the clamp assembly may at least partially comprise a silhouette that corresponds to a profile (e.g., a dovetail-like configuration) of the rail assembly of the firearm.

The firearm sight may include a main body assembly. The main body assembly may be operably attached to the housing. In some instances, the main body assembly may be stowed within the housing. In other instances, the main body assembly may be deployed from the housing. For example, the main body assembly may be slidably attached to the housing. In this manner, the main body assembly may slide from a position within the housing to a position extending from the housing. Moreover, the main body assembly may include one or more components of the firearm sight. For example, the main body assembly may include a light source and a power source, among other things.

A sight assembly may be operably attached to the main body assembly. For example, the sight assembly may be operably attached to a front portion or a back portion of the main body assembly. In some instances, the sight assembly may be rotatable about the main body assembly. For example, the sight assembly may be attached to the main body assembly by way of a hinge or the like. In some instances, the sight assembly may include a sight assembly frame, a reflective lens positioned about the sight assembly frame, and a sight indication displayed on the reflective lens. In this manner, the sight assembly frame may be rotatably attached to the main body assembly, and the light source may display the sight indication on the reflective lens. In some instances, the sight indication may be adjustable about the sight assembly.

The firearm sight may include a deployment mechanism operable to deploy the main body assembly and the sight assembly from a closed position at least partially within the housing to an open position at least partially outside of the housing. In some instances, the deployment mechanism may be a spring or the like. In certain embodiments, the main body assembly and the sight assembly may be folded together and at least partially positioned within the housing when in the closed position. Conversely, the main body assembly may be deployed at an angle relative to the housing when in the open position. In addition, the sight assembly may be substantially transverse to the main body assembly when in the open position. The main body assembly and the sight assembly may be in the open position when aiming the firearm.

A latch assembly may be operably attached to the housing. In some instances, the latch assembly may be configured to maintain the main body assembly and the sight assembly in the closed position. For example, the latch assembly may maintain the main body assembly and the sight assembly in the folded configuration within the housing in the closed position. Manipulation of the latch assembly, in cooperation with the deployment mechanism, may deploy the main body assembly and the sight assembly to the open position.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Illustrative Embodiments

FIGS. 1-12 schematically depict various embodiments of a firearm sight 100 (as well as individual components of the firearm sight 100) that can be attached to a firearm in accordance with one or more embodiments of the disclosure. The firearm may be a conventional firearm. In some instances, the firearm may be a handgun. In other instances, the firearm may be a rifle. By way of example, the firearm may be any number of firearms, such as, but not limited to, an M-16 style rifle, an AR-15 style rifle, an AR-10 style rifle, an M-4 style rifle, or the like. In some instances, the firearm may be a shotgun. Any firearm may be used herein. In some instances, the firearm may include an attachment point, such as a rail, a groove, or a channel, for attaching the firearm sight 100 to the firearm. In an example embodiment, the firearm may include a Picatinny rail assembly.

The firearm sight 100 may function as a secondary (or "back-up") firearm sight. That is, the firearm sight 100 may supplement a primary firearm sight. In some instances, the primary firearm sight may include an iron sight or a scope. In an example embodiment, the firearm sight 100 may be attached to the rail assembly of the firearm between an upper portion of the rail assembly and the primary firearm sight. In this manner, the firearm sight 100 may be attached to the firearm in an area that is otherwise unused. The firearm sight 100 may be attached at any location about the firearm. The firearm sight 100 may be deployed in instances where the primary firearm sight has malfunctioned or is inoperable.

In certain embodiments, the firearm sight 100 may include a housing 102. In some instances, the housing 102 may include a casing 104 and a plate 106. The casing 104 and the plate 106 may be coupled together by one or more fasteners 108 to form the housing 102. The housing 102 may include an opening 110 at one end. The opening 110 may enable one or more components of the firearm sight 100 to be stowed within or deployed from the housing 102. In some instances, the opening 110 may include an angled surface 112 relative to one or more internal surfaces of the housing 102. The angled surface 112 may facilitate deploying one or more components of the firearm sight 100 at an angle relative to the housing 102.

The housing 102 may be attached to a firearm. For example, an attachment assembly 114 may be configured to attach the housing 102 to the firearm. In some instances, the attachment assembly 114 may include a fixed clamp 116, a moveable clamp 118, and at least one coupling rod 120. The moveable clamp 118 may be operable to move relative to the fixed clamp 116 between a clamped position and an unclamped position. In some instances, the fixed clamp 116 may be integral with the casing 104. Moreover, the casing 104 may include a channel 122 disposed opposite the fixed clamp 116 that is configured to mate with a corresponding projection 124 of the moveable clamp 118. The coupling rod 120 may couple the fixed clamp 116 and the moveable clamp 118. For example, the casing 104 may include one or more bores 126 configured to receive the coupling rod 120, and the coupling rod 120 may be disposed within the bores 126 and attached to the moveable clamp 118. In this manner, manipulation (for example, tightening or loosening) of the coupling rod 120 may move the moveable clamp 118 between the clamped positioned and the unclamped position. In some instances, the coupling rod 120 may be configured to at least partially protrude between at least two mounting projections on the rail assembly of the firearm. Moreover, the attachment assembly 114 may at least partially comprise a silhouette that corresponds to a profile (such as a dovetail-like configuration) of the rail assembly of the firearm.

In certain embodiments, the firearm sight 100 may include a main body assembly 128. The main body assembly 128 may house one or more components of the firearm sight 100. For example, the main body assembly 128 may include a light source and a power source, among other things. The light source and the power source may be at least partially housed within the main body assembly 128. Any optics system may be housed within the main body assembly 128. In some instances, the power source may be a battery. The main body assembly 128 may include an on/off switch 130 for activating the light source and the power source. In some instances, the on/off switch 130 may be engaged by the thumb of a user grasping the firearm.

The main body assembly 128 may be operably attached to the housing 102. For example, the main body assembly 128 may be slidably coupled to the housing 102. In some instances, the main body assembly 128 may include one or more protrusions 132 extending from a distal end 134 and a proximal end 136 of the main body assembly 128. The housing 102 may include one or more slots 138 that correspond to the protrusions 132. The protrusions 132 may be disposed within the slots 138 and slide freely therein. The slots 138 may be configured to guide the protrusions 132 along a path. For example, when the main body assembly 128 is deployed from the housing 102, the protrusions 132 may slide along the slots 138 towards the angled surface 112. Once adjacent to the angled surface 112 (at the end of the slots 138), the protrusions 132 may pivot within the slots 138 such that a bottom surface 140 of the main body assembly 128 may be positioned adjacent to the angled surface 112. In this manner, the main body assembly 128 may be deployed at an angle relative to the housing 102. To stow the main body assembly 128, the main body assembly 128 may be pivoted and slid back into the housing 102 by way of the protrusions 132 and the slots 138.

A sight assembly 142 may be operably attached to the main body assembly 128. For example, the sight assembly 142 may be operably attached to the distal end 134 of the main body assembly 128. In some instances, the sight assembly 142 may be rotatable about the main body assembly 128. For example, the sight assembly 142 may be attached to the main body assembly 128 by way of a hinge 144. The hinge 144 may include a pair of projections 146 extending from the main body assembly 128. Each of the projections 146 may include an aperture 148 therethrough. Moreover, the hinge 144 may include a pair of corresponding apertures 150 in the sight assembly 142. In this manner, the apertures 148 in the projections 146 may be aligned with the apertures 150 in the sight assembly 142. A pin 152 (or screws) may be positioned within the apertures 148 in the projections 146 and the apertures 150 in the sight assembly 142 to rotatably secure the sight assembly 142 to the main body assembly 128. Any number of rotatable configurations may be used herein.

In some instances, the sight assembly 142 may include a sight assembly frame 154. The sight assembly frame 154 may include the apertures 150 discussed above. The sight assembly 142 also may include a reflective lens 156 positioned about the sight assembly frame 154. The reflective lens 156 may be any suitable material. For example, in some instances, the reflective lens 156 may be at least partially transparent and may include a somewhat reflective surface. The properties of the reflective lens 156 may vary. A sight indication 158 may be displayed on the reflective lens 156. For example, the light source within the main body assembly 128 may project the sight indication 158 onto the reflective lens 156. In some instances, the sight indication 158 may be a red dot or the like. The sight assembly frame 154 may be rotatably attached to the main body assembly 128, and the light source may display the sight indication 158 on the reflective lens 156.

In some instances, the sight indication 158 may be adjustable about the reflective lens 156. For example, a user may calibrate the firearm sight 100 by adjusting the position of the sight indication 158 about the reflective lens 156. In some instances, a user may adjust the sight indication 158 up and down about the reflective lens 156 by manipulating a knob 160. For example, the knob 160 may be in communication with the light source so as to adjust the light source up and down. In other instances, a user may adjust the sight indication 158 left and right about the reflective lens 156 by manipulating a knob 162. For example, the knob 162 may be in communication with the light source so as to adjust the light source left and right. In some instances, the knob 160 and the knob 162 may be adjusted with a tool, such as a flathead screwdriver or the like.

The light source may include a light-emitting diode, a tritium-powered light source, or any other source of suitable light. The light source can provide a constant source of light, or the light source may be switched between on and off depending on when the firearm sight 100 is in an open position or a closed position. The power or brightness of the light source may be adjusted automatically or manually. In some instances, the light source may be disposed about the main body assembly 128 opposite the sight assembly 142.

Figure 3:
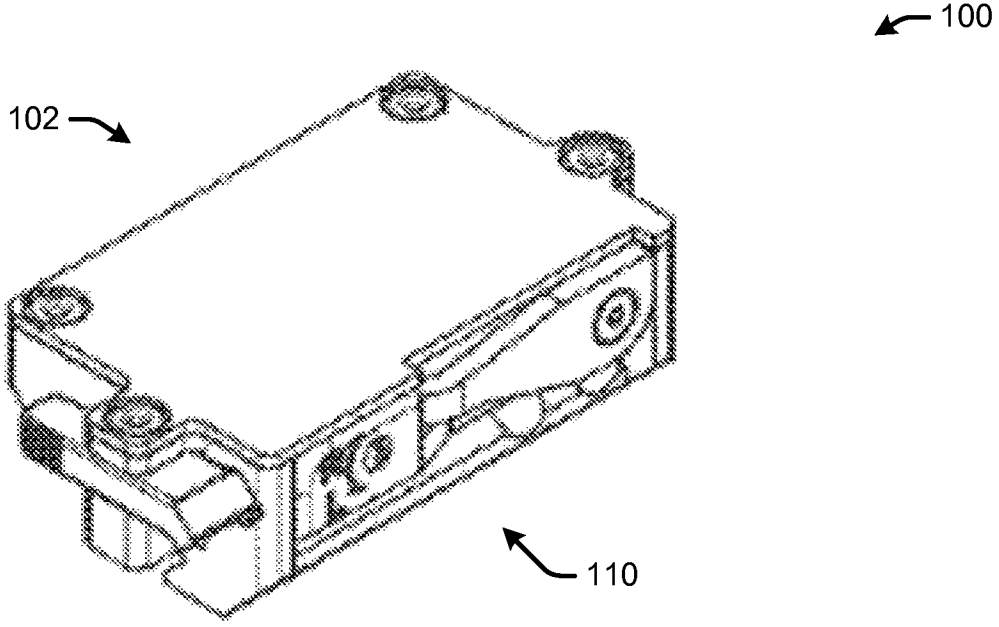
FIG. 3 schematically depicts a firearm sight in accordance with one or more embodiments of the disclosure.
Figure 4:
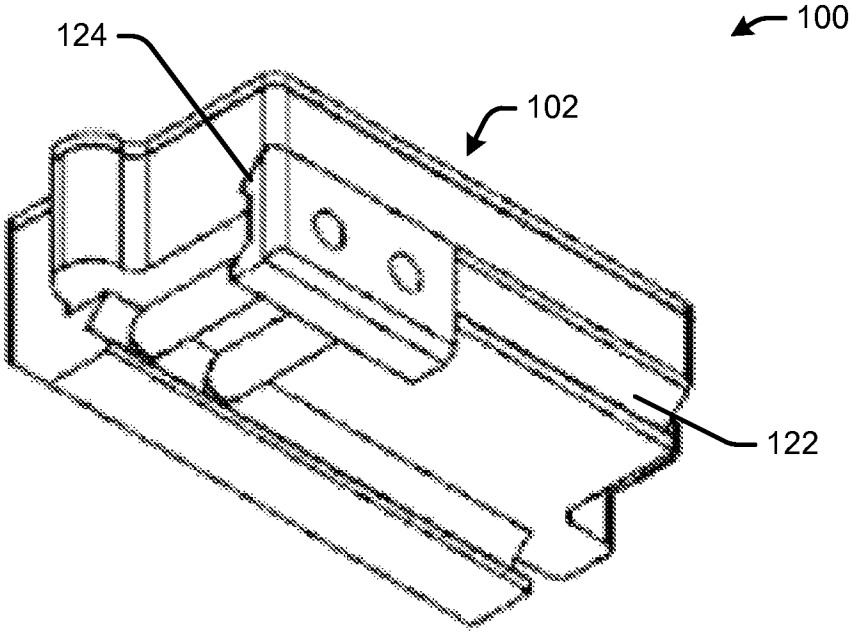
FIG. 4 schematically depicts a firearm sight in accordance with one or more embodiments of the disclosure.
Figure 5:
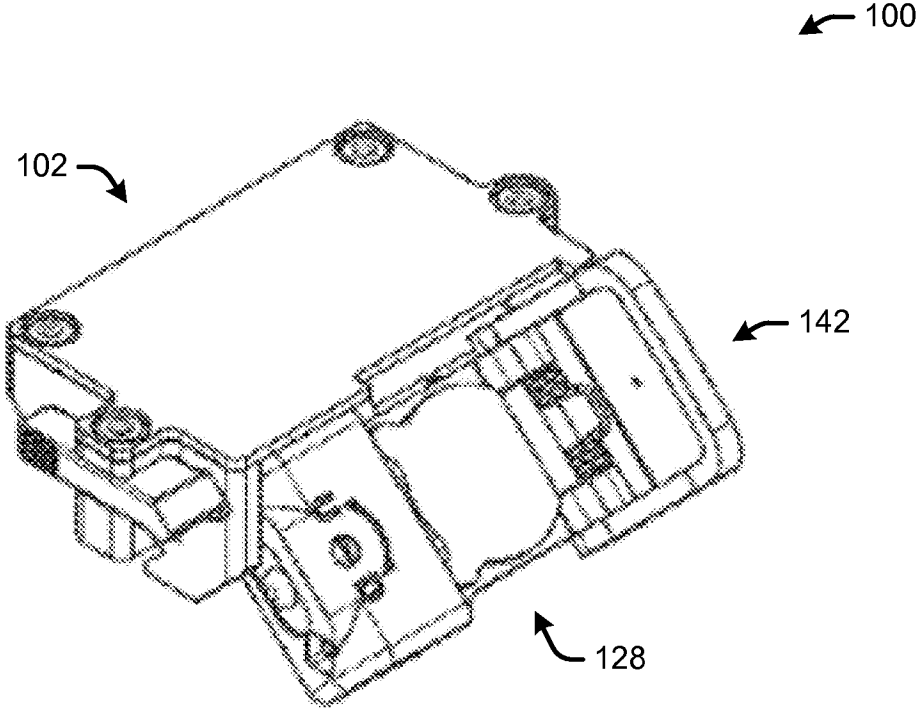
FIG. 5 schematically depicts a firearm sight in accordance with one or more embodiments of the disclosure.
Figure 6:
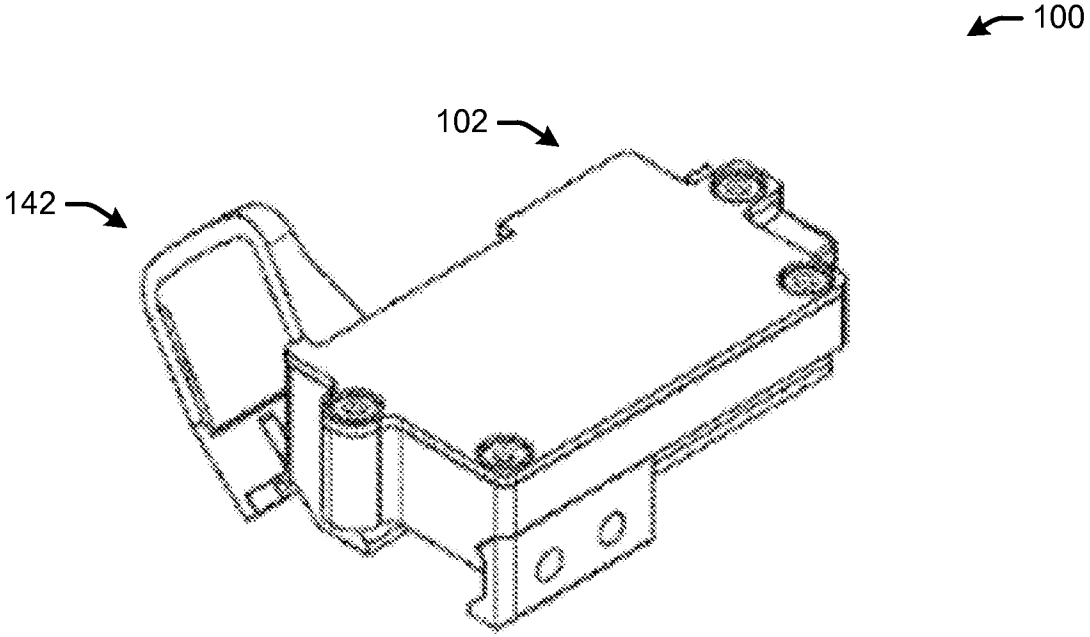
FIG. 6 schematically depicts a firearm sight in accordance with one or more embodiments of the disclosure.
Figure 7:
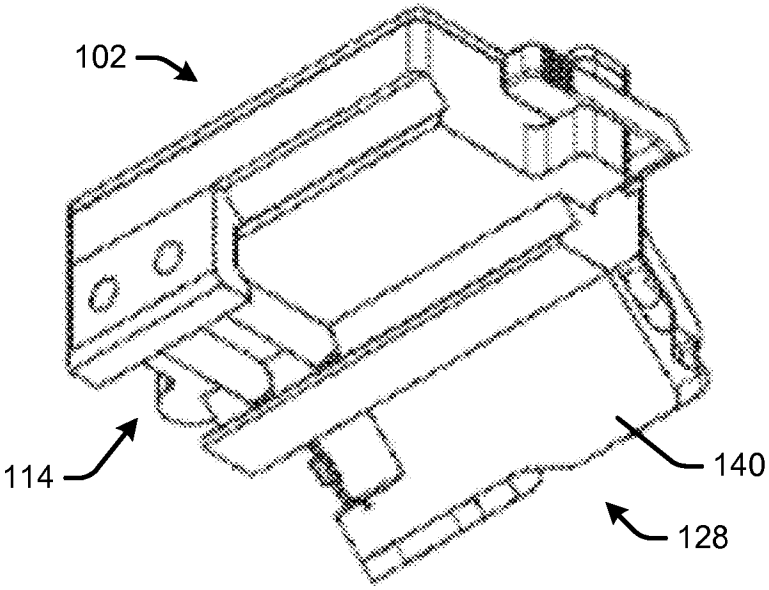
FIG. 7 schematically depicts a firearm sight in accordance with one or more embodiments of the disclosure.
Figure 8:
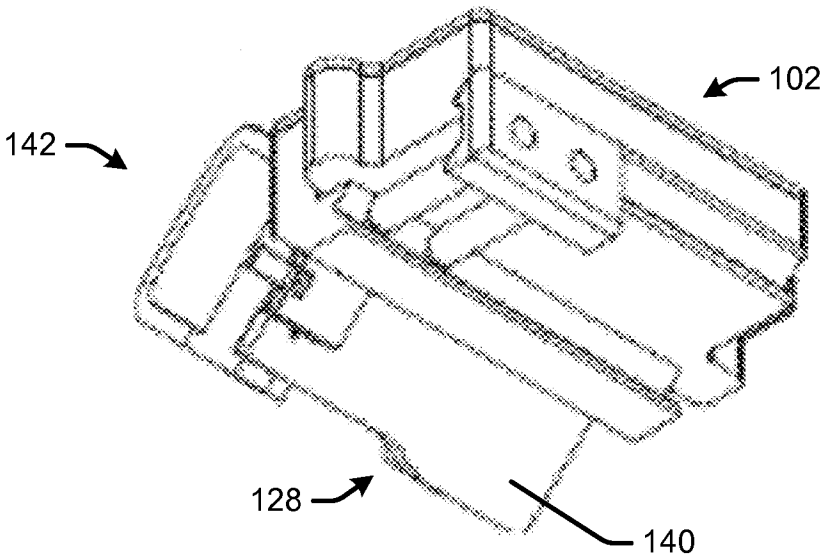
FIG. 8 schematically depicts a firearm sight in accordance with one or more embodiments of the disclosure.
Figure 9:
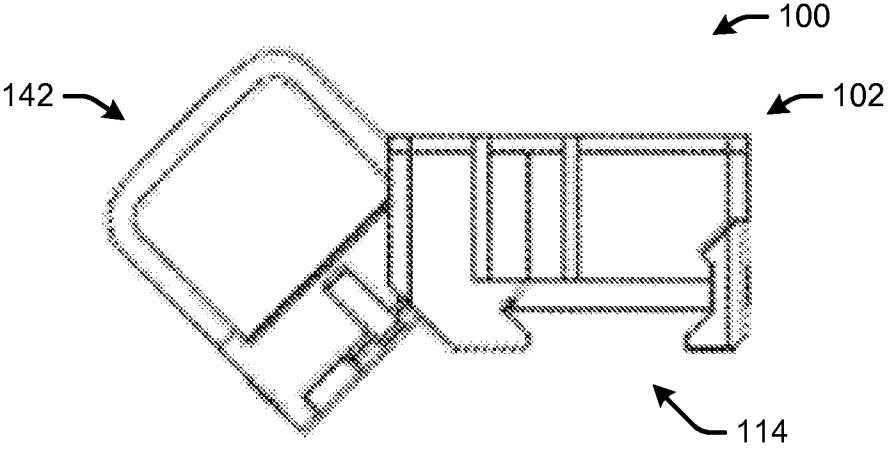
FIG. 9 schematically depicts a firearm sight in accordance with one or more embodiments of the disclosure.
Figure 10:
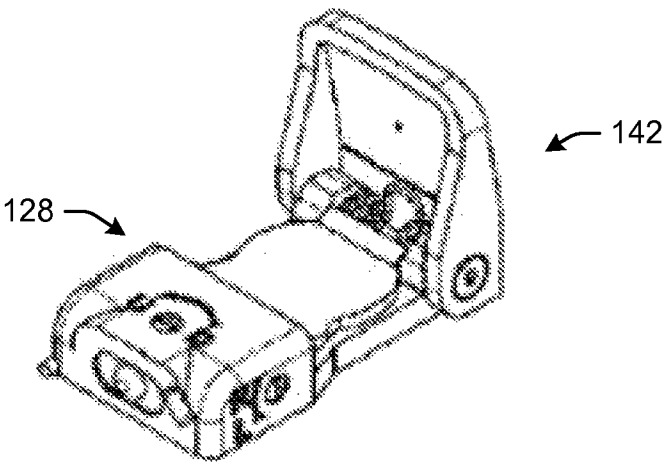
FIG. 10 schematically depicts a firearm sight in accordance with one or more embodiments of the disclosure.
Figure 11:
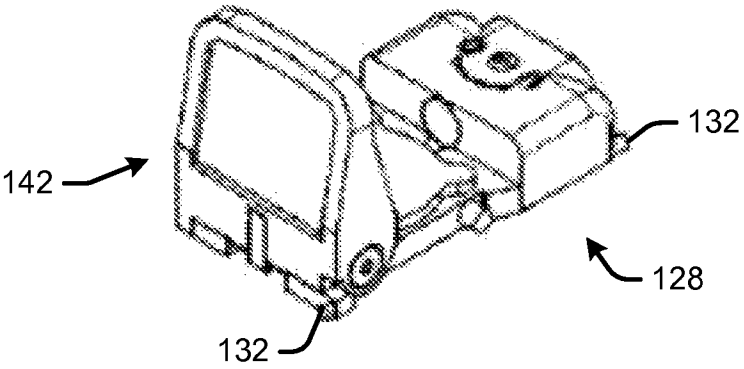
FIG. 11 schematically depicts a firearm sight in accordance with one or more embodiments of the disclosure.
Figure 12:
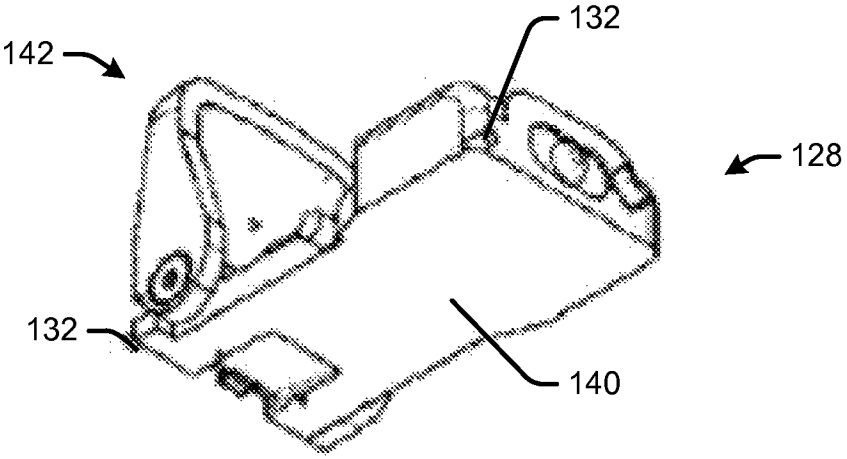
FIG. 12 schematically depicts a firearm sight in accordance with one or more embodiments of the disclosure.

The firearm sight 100 may include a deployment mechanism 164 operable to deploy the main body assembly 128 and the sight assembly 142 from a closed position (as depicted in FIG. 3) to an open position (as depicted in FIG. 1). In some instances, the deployment mechanism 164 may be a spring or the like. For example, the deployment mechanism 164 may be a coil spring 166. The coil spring 166 may be positioned about the sight assembly 142 and the main body assembly 128. The coil spring 166 may bias the main body assembly 128 and the sight assembly 142 in the open position. For example, the coil spring 166 may tend to urge the sight assembly 142 from the folded position (i.e., closed position) to the extended position (i.e., open position). In turn, the coil spring 166 may tend to urge the main body assembly 128 from the closed position within the housing 102 to the open position outside of the housing 102. That is, as the sight assembly 142 presses against the housing 102, the main body assembly 128 may tend to slide from the closed position to the open position by way of the protrusions 132 and slots 138. In some instances, a stabilizer/latch assembly 168 may cooperate with the deployment mechanism 164 to maintain the sight assembly 142 in the closed position and the open position.

In certain embodiments, the main body assembly 128 and the sight assembly 142 may be folded together and at least partially positioned within the housing 102 when in the closed position. Conversely, the main body assembly 128 may be deployed at an angle relative to the housing 102 when in the open position. In addition, the sight assembly 142 may be substantially transverse to the main body assembly 128 when in the open position. The main body assembly 128 and the sight assembly 142 may be in the open position when aiming the firearm. The firearm sight 100 may be moved to the closed position by rotating the sight assembly 142 from the extended position to the folded position and then pivoting and sliding the main body assembly 128 into the housing 102.

A latch assembly 170 may be operably attached to the housing 102. For example, the latch assembly 170 may be attached to the housing 102 by way of a pivot 172. In some instances, the latch assembly 170 may be configured to maintain the main body assembly 128 and the sight assembly 142 in the closed position. For example, the latch assembly 170 may include a latch 174 that at least partially extends through a hole 176 in the housing 102. The latch 174 may engage a notch 178 in the main body assembly 128. In some instances, a user may manipulate the latch 174 to disengage the notch 178 in the main body assembly 128. Once disengaged, the main body assembly 128 and the sight assembly 142 may deploy to the open position.

The latch assembly 170 may maintain the main body assembly 128 and the sight assembly 142 in the folded configuration within the housing 102 in the closed position. Manipulation of the latch assembly 170, in cooperation with the deployment mechanism 164, may deploy the main body assembly 128 and the sight assembly 142 to the open position. In some instances, the latch assembly 170 may be engaged by the thumb of a user grasping the firearm.

Illustrative Methods

Figure 13:
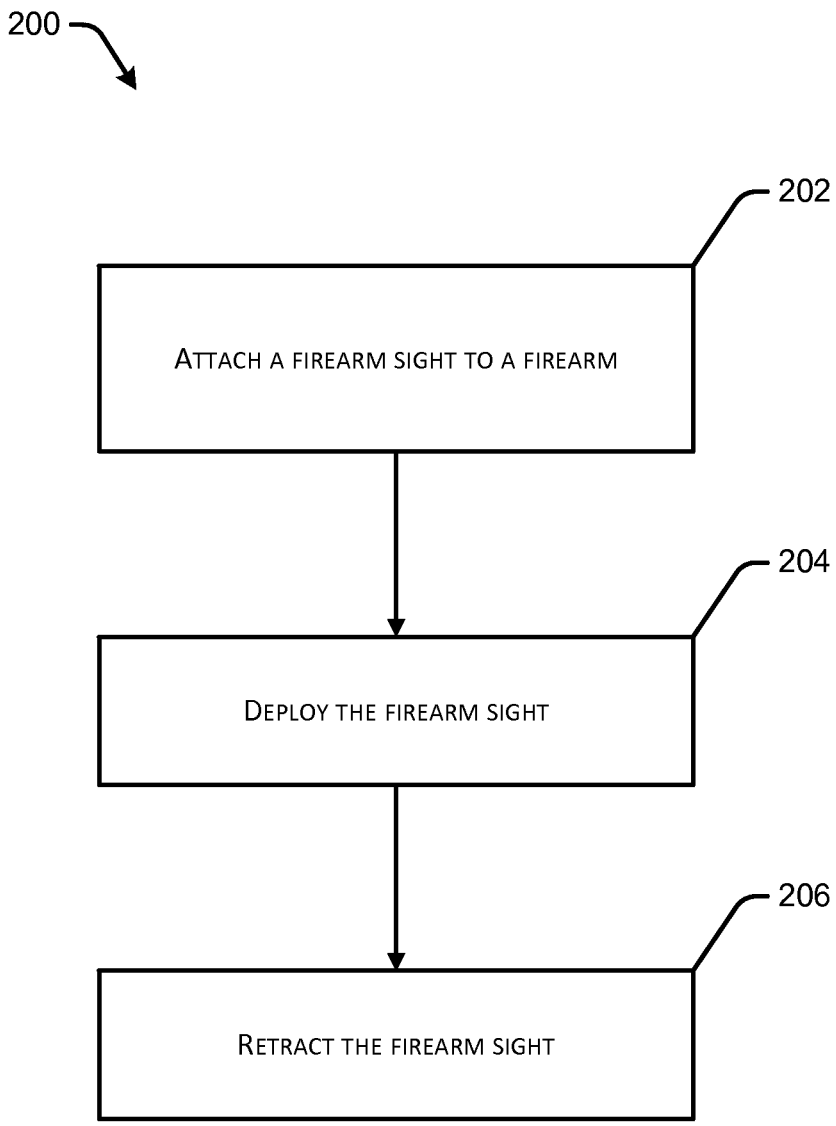
FIG. 13 is a flow diagram depicting an illustrative method for providing a firearm sight in accordance with one or more embodiments of the disclosure.

FIG. 13 is a flow diagram depicting an illustrative method 200 for providing the firearm sight 100 shown in FIGS. 1-12 in accordance with one or more embodiments of the disclosure. In certain embodiments, the firearm sight 100 may provide improved maneuverability and/or configurability. For example, the firearm sight 100 may be stowed and deployed with relative ease.

At block 202 of the method 200, the firearm sight 100 may be attached to a firearm. For example, the attachment assembly 114 may be configured to attach the housing 102 to the firearm. The moveable clamp 118 may be operable to move relative to the fixed clamp 116 between a clamped position and an unclamped position. In some instances, the fixed clamp 116 may be integral with the casing 104. The coupling rod 120 may couple the fixed clamp 116 and the moveable clamp 118. For example, the coupling rod 120 may be disposed within the bores 126 and attached to the moveable clamp 118. In this manner, manipulation (for example, tightening or loosening) of the coupling rod 120 may move the moveable clamp 118 between the clamped position and the unclamped position. In some instances, the coupling rod 120 may be configured to at least partially protrude between at least two mounting projections on the rail assembly of the firearm. Moreover, the attachment assembly 114 may at least partially comprise a silhouette that corresponds to a profile (such as a dovetail-like configuration) of the rail assembly of the firearm.

The firearm sight 100 may be deployed to the open position at block 204 of the method 200. For example, the latch assembly 170 may maintain the main body assembly 128 and the sight assembly 142 in the folded configuration within the housing 102 in the closed position. Manipulation of the latch assembly 170, in cooperation with the deployment mechanism 164, may deploy the main body assembly 128 and the sight assembly 142 to the open position. In the open position, the main body assembly 128 may be deployed at an angle relative to the housing 102. In addition, the sight assembly 142 may be substantially transverse to the main body assembly 128 when in the open position. The main body assembly 128 and the sight assembly 142 may be in the open position when aiming the firearm.

At block 206 of the method 200, the firearm sight 100 may be refracted to the closed position. For example, the firearm sight 100 may be moved to the closed position by rotating the sight assembly 142 from the extended position to the folded position and then pivoting and sliding the main body assembly 128 into the housing 102. The latch 174 may engage the notch 178 to maintain the main body assembly 128 and the sight assembly 142 in the closed position.

The operations described in blocks 202-206 of the method 200 may be performed in any order. Moreover, certain operations may be omitted, while other operations may be added.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or operations. Thus, such conditional language is not generally intended to imply that features, elements, and/or operations are in any way required for one or more embodiments.

That which is claimed is:

1. A firearm sight, comprising:

a housing attachable to a firearm, wherein the housing comprises an opening at one end thereof and an angled surface at the opening;

a main body assembly slidably attached to the housing;

a sight assembly rotatably attached to the main body assembly;

a deployment mechanism operable to deploy the main body assembly and the sight assembly from a closed position at least partially within the housing to an open position at least partially outside of the housing; and a latch assembly pivotably attached to the housing and configured to maintain the main body assembly and the sight assembly in the closed position, wherein manipulation of the latch assembly, in cooperation with the deployment mechanism, deploys the main body assembly and the sight assembly to the open position, wherein a bottom surface of the main body assembly is disposed on the angled surface in the open position, and wherein the main body assembly is disposed at an angle relative to the housing when in the open position.

2. The firearm sight of claim 1, wherein the main body assembly comprises a light source configured to display a sight indication on the sight assembly.

3. The firearm sight of claim 2, wherein the sight indication is adjustable about the sight assembly.

4. The firearm sight of claim 1, wherein the sight assembly comprises:

a sight assembly frame;

a reflective lens positioned about the sight assembly frame; and a sight indication displayed on the reflective lens.

5. The firearm sight of claim 1, wherein the main body assembly and the sight assembly are folded together and at least partially positioned within the housing when in the closed position.

6. The firearm sight of claim 1, wherein the main body slides along a first plane within the housing and is deployed in the open position at an angle relative to the first plane.

7. The firearm sight of claim 1, wherein the sight assembly is substantially transverse to the main body assembly when in the open position.

8. The firearm sight of claim 1, further comprising an attachment assembly configured to attach the housing to the firearm.

9. The firearm sight of claim 8, wherein the attachment assembly comprises:

a fixed clamp;

a moveable clamp operable to move relative to the fixed clamp between a clamped position and an unclamped position; and at least one coupling rod positioned between the fixed clamp and the moveable clamp, wherein manipulation of the at least one coupling rod moves the moveable clamp between the clamped position and the unclamped position.

10. The firearm sight of claim 9, wherein the at least one coupling rod is configured to at least partially protrude between at least two mounting projections on a rail assembly of the firearm.

11. The firearm sight of claim 9, wherein the clamp assembly at least partially comprises a silhouette that corresponds to a profile of a rail assembly of the firearm.

* * * * *